US005353921A

United States Patent [19]

Tyra

[11] Patent Number: 5,353,921

[45] Date of Patent: Oct. 11, 1994

[54] INSIGNIA CASE

[76] Inventor: D. Lee Tyra, P.O. Box 937, Portland, Tex. 78374

[21] Appl. No.: 112,935

[22] Filed: Aug. 30, 1993

[51] Int. Cl.[5] ..... B65D 81/00

[52] U.S. Cl. ..... 206/6.1; 206/523

[58] Field of Search ..... 206/0.8, 0.82, 6.1, 206/14, 314, 317, 523, 566, 568, 495

[56] References Cited

U.S. PATENT DOCUMENTS

| | | | |
|---|---|---|---|
| 750,817 | 2/1904 | Crenshaw | 206/317 |
| 2,706,036 | 4/1955 | Neal | 206/317 |
| 2,860,768 | 11/1958 | Smithers | 206/523 |
| 2,872,960 | 2/1959 | Kolpin | 206/317 |
| 3,017,023 | 1/1962 | Peterman et al. | 206/594 |
| 3,181,693 | 5/1965 | Freistat | 206/523 |
| 4,934,534 | 6/1990 | Wagner | 206/568 |

FOREIGN PATENT DOCUMENTS

| | | | |
|---|---|---|---|
| 1451468 | 7/1966 | France | 206/523 |

*Primary Examiner*—Jimmy G. Foster
*Attorney, Agent, or Firm*—G. Turner Moller

[57] ABSTRACT

A case is provided for holding and displaying military insignia. The case is of injection molded plastic having a bottom and a hinged top. The bottom provides a foam rubber layer covered by a felt like material. A recess in the foam rubber layer provides a convenient home for keepers used to retain the insignia on the user's garment. The prongs of the insignia are pressed through the felt covering into the foam layer in any pattern desired by the user. The top also includes a foam/felt layer so that when the top closes, the two layers abut to retain the insignia in place.

10 Claims, 1 Drawing Sheet

INSIGNIA CASE

Figure 1:
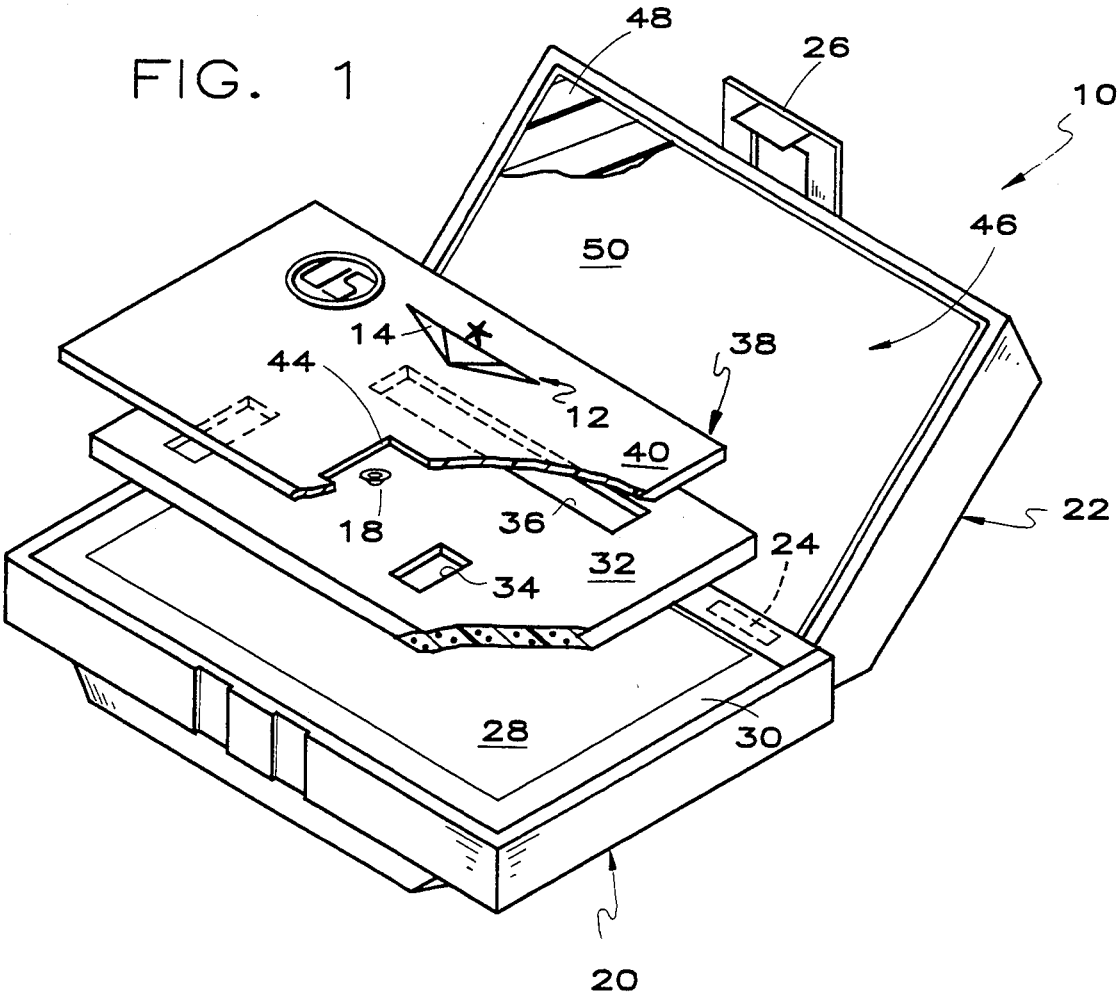

This invention relates to a case and, more particularly, to a case for holding and displaying insignia and awards, such as earned and worn by the military, police, firemen and the like.

Storing or displaying insignia or awards is awkward. In the case of the military, insignia such as brass, campaign ribbons, medals and the like are usually piled into a jewelry box until ready to be worn. Spit and polish military types don't want to look in such jewelry boxes, lest what they will find. Displaying military or other types of insignia is equally awkward because the display usually has to be prepared and then dismantled.

Boxes in which jewelry can be stored and shipped are shown in U.S. Pat. Nos. 3,125,221; 3,930,576; 4,101,023 and 4,732,269. A storage case of some pertinence is shown in U.S. Pat. No. 2,518,450.

In this invention, a more-or-less conventional case provides a bottom and top hinged for movement between an open position and a closed position. A first foam layer in the bottom provides a felt like covering and a second thicker foam layer underlies the first foam layer. The top also includes a foam layer with a felt like covering. The prongs of the insignia are inserted at any desired location through the felt covering into the foam layer of the bottom so the flat part of the insignia abuts the felt covering. When the top and bottom are closed, the felt coverings abut thereby holding the insignia in place. When the top is open, the insignia are exposed so the case acts as a display.

It is an object of this invention to provide a case particularly adapted to store and display insignia, awards or the like such as earned and worn by the military, police or firemen.

Another object of this invention is to provide a case for insignia or awards which snugly holds the insignia when the case is closed and neatly displays the insignia when the case is open.

These and other objects of this invention will become more fully apparent as this description proceeds, reference being made to the accompanying drawings and appended claims.

IN THE DRAWINGS

Figure 2:
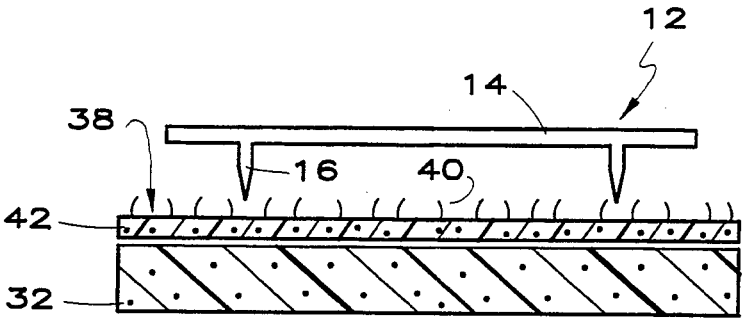

FIG. 1 is an isometric view of the insignia case of this invention, illustrating the case in an open position; and FIG. 2 is a cross-sectional view of the case of FIG. 1, taken substantially along line 2—2 thereof, as viewed in the direction indicated by the arrows.

Referring to FIGS. 1–2, a case 10 is provided for insignia 12 of the type comprising a flat section 14 having one or more prongs 16 and a like number of keepers 18. Those skilled in the art will recognize that the insignia 12 is worn on the shirt or coat of the wearer by extending the prongs through the garment fabric and then attaching the keeper 18 to the prongs 16. The insignia may be of any type, such as brass worn on a shirt collar, campaign ribbons or medals worn above the left pocket, divisional insignia worn on the epaulet or the like.

The case 10 comprises a bottom section 20, a top section 22 and a hinge 24 connecting the bottom and top sections 20, 22 for movement between open and closed positions. A latch 26 retains the case in the closed position. Although the case 10 may be made of any suitable material, such as wood or metal, it is preferably of injection molded plastic.

The bottom section 20 includes a recessed bottom wall 28 having a raised peripheral lip 30. A relatively thick foam layer 32 is glued to the bottom wall and provides a first pair of small rectangular cutouts or recesses 34 adjacent the front end of the bottom 20 and a larger more elongate recess 36. The recesses 34 provide a hiding place for small insignia. The recess 36 provides a hiding place for larger insignia. A relatively thin foam layer 38 is sufficiently large to cover the foam layer 32 and rests on the layer 32. The foam layer 38 includes a felt like outer covering 40 bonded to a quite thin foam inner layer 42. Although the felt covering 40 and foam layer 42 may be of any suitable type, a preferred material is known as a flocked foam in which short lengths of a felt like material are bonded to a foam layer. Such as material is commercially available from Diversified Foam, Inc. of Yatkinville, N.C.

A recess 44 is provided in the foam layer 38 to receive the keepers 18. The recess 44 is approximately as wide as the spacing between the recesses 34 and is approximately as long as the length of the recesses 34, measured parallel to the long dimension of the recesses 34, i.e. perpendicular to the long dimension of the recess 36.

It will accordingly be seen that the recesses 34, 36 provide space for odd or undisplayed insignia. Because the foam layer 38 completely covers the recesses 34, 36, they are hidden.

The top 22 includes a backing 46 having a foam layer 48 glued or otherwise bonded to the top 22 and a felt like covering 50. The foam layer 48 and felt covering 50 preferably comprises the same flocked foam used in the bottom section 20. When the case 10 is closed, the felt covering 50 touches or abuts the insignia 12 to keep them in place. Because of the resiliency of the foam layers 32, 42, 48, insignia having considerable relief can be accommodated.

Use of the case 10 should now be apparent. To store or display one of the insignia 12, the keepers 18 are removed and placed in the recess 44. The prongs 16 pushed through the felt covering 40 and thin foam layer 42 into the foam layer 32. Because the felt covering 40 has no prepunched holes in it, the insignia 12 may be displayed in any desired arrangement, depending on the nature of the insignia. For a while, the felt covering 40 is self healing, in the sense that the prongs 16 may be removed and the hole formed thereby heals so it is not noticeable. After the case 10 is in use for a while, the pattern of the insignia becomes evident on the felt covering 40 and the holes formed by the prongs 16 become apparent. When the case 10 is closed, the insignia are kept in their position because they abut the felt covering 50 in the top 22. When the case 10 is opened, the insignia are displayed.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

I claim:

1. A case for holding insignia of the type comprising a relatively flat section having at least one prong perpendicular to the flat section, comprising a bottom, a top and means connecting the top and bottom together allowing movement between a closed position and an open position;

a first foam layer in the bottom having a first recess therein;

a second layer having a first covering of felt like material capable of passing the prong therethrough and having a second recess therein for receiving keepers attachable to the prongs, the second recess being out of registry with the first recess and extending through the second foam layer to provide an opening through the second foam layer and exposing the first foam layer, the second foam layer lying upon and being unconnected to the first foam layer; and a third foam layer in the top having a second covering of felt like material, the first and second coverings abutting in the closed position of the top and bottom.

2. The case of claim 1 wherein the first foam layer is bonded to the bottom and the third foam layer is bonded to the top.

3. The case of claim 1 wherein the first foam layer is substantially thicker than the second foam layer.

4. The case of claim 1 further comprising a plurality of insignia including a relatively flat central section and at least one prong extending from the central section, the prong extending into the first foam layer and through the first felt covering, the second felt covering abutting the central section in the closed position of the case.

5. The case of claim 4 wherein the first foam layer is free of straight passages therethrough of a size to pass the prongs.

6. The case of claim 1 wherein the second layer is a foam material.

7. A case for holding insignia of the type comprising a relatively flat section having at least one prong perpendicular to the flat section, comprising a bottom, a top and means connecting the top and bottom together allowing movement between a closed position and an open position;

a first foam layer in the bottom having a first covering of felt like material capable of passing the prong therethrough;

a second foam layer in the top having a second covering of felt like material, the first and second coverings abutting in the closed position of the top and bottom; and a plurality of insignia including a relatively flat central section and at least one prong extending from the central section, the prong extending into the first foam layer and through the first felt covering, the second felt covering abutting the central section in the closed position of the case.

8. The case of claim 7 wherein the first foam layer is free of straight passages therethrough of a size to pass the prongs.

9. A case for holding insignia of the type comprising a relatively flat section having at least one prong perpendicular to the flat section, comprising a bottom, a top and means connecting the top and bottom together allowing movement between a closed position and an open position;

a first foam layer in the bottom having a first recess therein;

a second layer having a first covering of felt like material capable of passing the prong therethrough and having a second recess therein for receiving keepers attachable to the prongs, the second recess being out of registry with the first recess, the second foam layer lying upon and being unconnected to the first foam layer; and a third foam layer in the top having a second covering of felt like material, the first and second coverings abutting in the closed position of the top and bottom; and a plurality of insignia including a relatively flat central section and at least one prong extending from the central section, the prong extending into the first foam layer and through the first felt covering, the second felt covering abutting the central section in the closed position of the case.

10. The case of claim 9 wherein the first foam layer is free of straight passages therethrough of a size to pass the prongs.

* * * * *